US006112963A

United States Patent [19]

Pratt

[11] Patent Number: 6,112,963

[45] Date of Patent: Sep. 5, 2000

[54] APPARATUS FOR CARRYING AND STORING SLEEPING BAGS AND OTHER RELATED ARTICLES

[76] Inventor: Valeri Pratt, 1925 Beverly Pl., South Bend, Ind. 46616

[21] Appl. No.: 09/298,436

[22] Filed: Apr. 23, 1999

[51] Int. Cl.[7] ..... A45F 3/14

[52] U.S. Cl. ..... 224/250; 224/257; 224/436; 224/578; 294/149; 294/150; 294/156

[58] Field of Search ..... 224/250, 156, 224/575, 576, 578, 579, 580, 581, 586, 600, 601, 602, 608, 604, 605, 615, 616, 617, 650, 651, 663, 665, 671, 673, 674, 254, 272, 436, 437, 420; 5/413; 294/149, 150, 154, 156, 158, 153

[56] References Cited

U.S. PATENT DOCUMENTS

| | | | |
|---|---|---|---|
| 595,843 | 12/1897 | Adams | 224/436 |
| 829,879 | 8/1906 | Mallon | 294/76 |
| 1,222,973 | 4/1917 | Morter | 294/15 |
| 1,952,465 | 3/1934 | Rycroft . | |
| 2,133,717 | 10/1938 | Robes, Jr. . | |
| 3,964,113 | 6/1976 | Dean, II . | |
| 4,282,279 | 8/1981 | Strickland | 428/101 |
| 4,604,765 | 8/1986 | Schultz . | |
| 5,207,360 | 5/1993 | Stine | 224/436 |
| 5,287,571 | 2/1994 | Rademacher . | |
| 5,333,769 | 8/1994 | Skroski . | |
| 5,404,600 | 4/1995 | DeMars . | |
| 5,560,056 | 10/1996 | Tai . | |

*Primary Examiner*—Gregory M. Vidovich
*Assistant Examiner*—Maerena W. Brevard
*Attorney, Agent, or Firm*—C. Bart Sullivan

[57] ABSTRACT

An apparatus for carrying and storing sleeping bags and other related items is disclosed having an adjustable enclosure formed by a strap having ends that pass through two substantially parallel tubes attached to, or formed on, the enclosure material. The straps ends have a clip that allows each end to be clipped to the body of the strap to form loops on each end that define the opening of the enclosure. Thereby the enclosure opening is adjustable in size to adapt to fit a single item such as a sleeping bag or combinations of articles to be carried or stored simultaneously.

2 Claims, 2 Drawing Sheets

APPARATUS FOR CARRYING AND STORING SLEEPING BAGS AND OTHER RELATED ARTICLES

BACKGROUND

1. Field of Invention

This invention relates an apparatus for carrying or storing articles such as sleeping bags and other related items such as pillows and blankets.

2. Description of Prior Art

It is well know that there are alternate means for carrying and storing articles such as sleeping bags and other related items such as pillows, blankets, and clothing etc. It is preferred that the above items carried or stored take up as little space as possible and be carried either as a single item within the apparatus or in combination. It is also preferred that the apparatus allow the items mentioned herein to be stored or carried conveniently as possible. However, it may be noted from a review of the prior art, that the prior art is not capable of both storage and carrying all of the mentioned items in combination without exceeding the scope of the prior art.

Reviewing each of the prior art it is apparent that these devices are designed for carrying a sleeping bag in a rolled or folded position. Much of the prior art description embodies only sleeping bags, making no mention of any other articles that may be carried or stored either individually, or in combination.

SUMMARY OF INVENTION—OBJECTS AND ADVANTAGES

It is the primary object of this invention to provide a storage and carrying apparatus made of a washable material for items such as sleeping bags, pillows, clothing type items, and other related items either individually or in combination, that is convenient to use. A further object of this invention to provide a flexible enclosure for the above items, that is adjustable to hold the above items therein. It is an object of this invention to use a flexible strap to both form the enclosure shape and to allow the enclosure opening to be adjustable. It is an object of this invention to allow the enclosure to be shaped by having the ends of the strap form loops by allowing each strap end to be connectable along the strap. The size of the enclosure formed would be dependent upon the size of each loop formed. It is an object of this invention that the strap may be removed from the apparatus so that the material may be washed without the strap. It is also an object of this invention to provide an apparatus that may be hung from the strap by using any convenient hanging means.

DETAILED DESCRIPTION OF THE PREFERRED EMBODIMENTS

Figure 1:
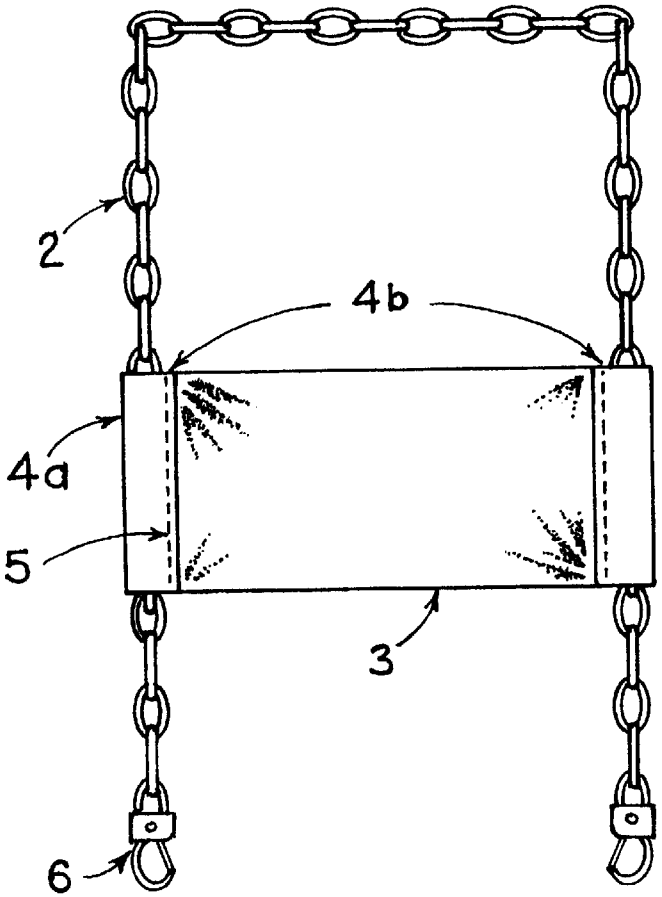
FIG. 1 is a top view of the apparatus showing the enclosure unfolded and the chain link strap.
Figure 3:
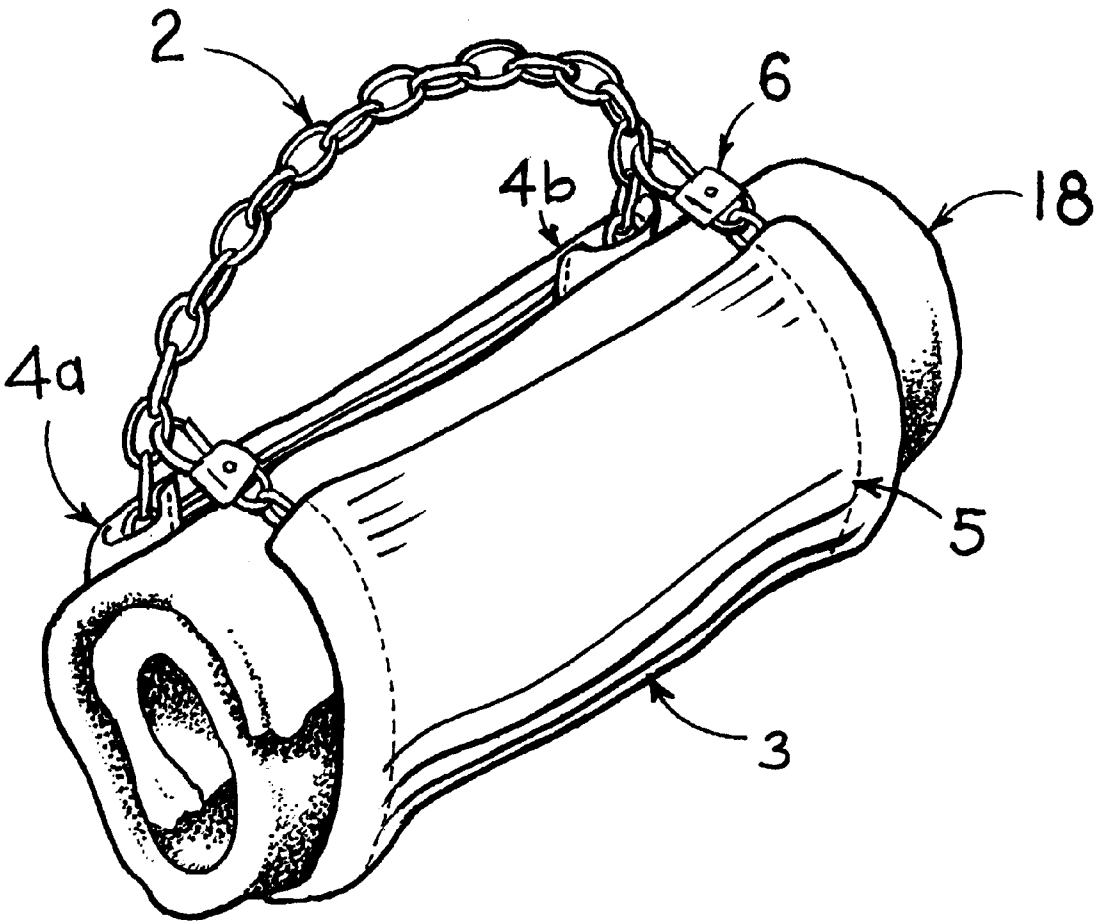
FIG. 3 is a perspective view of the invention in use holding a sleeping bag.

FIG. 1 shows one embodiment of the present invention comprised of an enclosure 3 formed from flexible material that may be washable. The enclosure 3 comprises at least two parallel tubes 4A having an axial opening 4B therein. One each of the parallel tubes 4A being flexibly attached to the enclosure 3 on opposing edges 5 of the enclosure 3. Each of the parallel tubes 4A may be formed by creating a fold in the enclosure 3 material. The fold in the enclosure 3 material being attached adjacent to each opposing edge 5 to the enclosure 3, by any suitable attachment means, thereby forming the parallel tubes 4A of the enclosure 3. The parallel tubes 4A also may be made of any suitable material that may be washable and then attached to the enclosure 3 by any common attachment means along the edges 5 of the enclosure material 3.

The invention also comprises at least one removable strap 2 made of a flexible material suitably sized to allow passage through the tubes 4A axial opening 4B so that the strap 2 is held therein the tubes 4A. Each end of the strap 2 extends through the tubes 4A. Each end of the strap 2 has at least one clip 6 suitable designed to clip to the strap 2. The ends of the strap 2 are connectable to and positioned along the strap 2 by attachment of the clip 6 to the strap 2 such that a loop is formed. Therefore, The flexible tubes 4A being movably positioned along the strap 2 define an opening for the enclosure 3 coextensive with each loop. In this embodiment the strap 2 is made from a chain link material.

Figure 2:
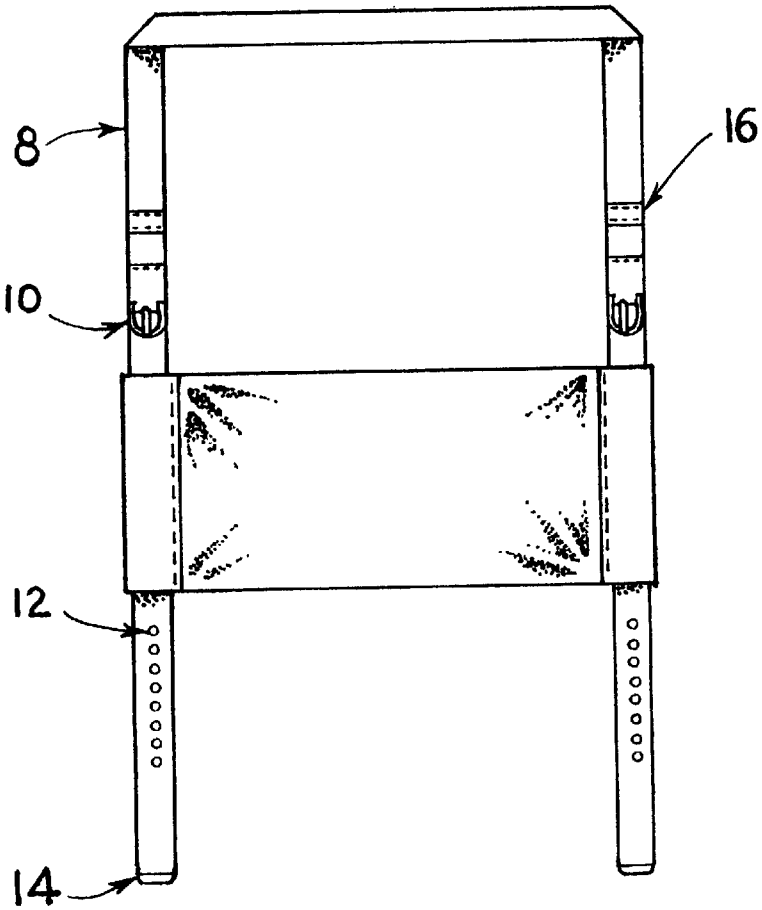
FIG. 2 is a top view of the apparatus showing the enclosure unfolded and the cloth strap.

FIG. 2 shows a second embodiment of the present invention having a cloth strap 8 made of a cloth type material suitably sized to allow passage through the tubes 4A axial opening 4B. In this embodiment each cloth strap 8 has a buckle 10 attached along the body of the cloth strap 8 positioned above each of the tubes 4A axial opening 4B. Each portion of the strap 8 that extend from the tubes 4A axial opening 4B have a plurality of holes 12 thereon suitably adapted for use with the buckles 10. Each end of the strap 8 is connected to an adjacent buckle 10 to form a loop. There is at least two additional ties 16 along the strap 8 to allow excess strap 8 material to be held as needed, close to the strap 8. Each end of the strap 8 contains a metal cap 14 to seal the ends of the strap 8 from fraying, and to allow for ease of insertion of the ends of the strap 8 through the buckles 10.

The description herein provides preferred embodiments of the present invention but should not be construed as limiting the scope of this apparatus herein Variations in enclosure size, material and flexibility, as well as variations in the strap material other than those shown and described herein, can be incorporated into the present invention. Thus, the appended claims and their legal equivalents should determine the scope of the present invention, rather than the examples given.

I claim:

1. An apparatus for carrying or storing sleeping bags and other related articles, said apparatus comprising:

(A) a substantially flexible and washable material, said material having at least two substantially parallel edges, (B) a removable strap means for forming said material into an enclosure having an adjustable opening to accept articles therein, said strap means having a first end and a second end, (C) means for flexibly holding said strap means to said edges, and (D) means for connecting each of said strap ends to an adjacent position along said strap to form a loop using each strap end, defining the enclosure openings, whereby when said loop is formed on each end the material defines an opening for said enclosure;

wherein said strap means being formed of a chain link material and said means for connecting said strap being a clip suitably designed to be clipped to a link of said chain link material to allow formation of said loop.

2. An apparatus for carrying or storing articles as found in claim 1 whereas:

(A) said means for flexibly holding said strap means to said edges comprises each of said edge being folded along a longitudinal axis parallel to its side and attached to said enclosure using any suitable attachment means forming a tube adapted to hold said strap means therein.

* * * * *